United States Patent [19]

Okamura et al.

[11] Patent Number: 5,028,510

[45] Date of Patent: Jul. 2, 1991

[54] SILVER HALIDE PHOTOGRAPHIC MATERIAL

[75] Inventors: Hisashi Okamura; Takahiro Goto; Kazonobu Katoh, all of Kanagawa, Japan

[73] Assignee: Fuji Photo Film Co., Ltd., Kanagawa, Japan

[21] Appl. No.: 525,019

[22] Filed: May 18, 1990

[30] Foreign Application Priority Data

May 19, 1989 [JP] Japan ..... 1-126284

[51] Int. Cl.[5] ..... G03C 1/06

[52] U.S. Cl. ..... 430/264; 430/411; 430/598

[58] Field of Search ..... 430/264, 598, 411

[56] References Cited

U.S. PATENT DOCUMENTS 4,816,373 3/1989 Ohashi et al. ..... 430/264
4,824,764 4/1989 Inaga et al. .
4,937,160 6/1990 Rüger ..... 430/264

FOREIGN PATENT DOCUMENTS 0330109 8/1989 European Pat. Off. ..... 430/498

*Primary Examiner*—Charles L. Bowers, Jr.
*Assistant Examiner*—Thorl Chea
*Attorney, Agent, or Firm*—Sughrue, Mion, Zinn, Macpeak & Seas

[57] ABSTRACT

A silver halide photographic material having at least one hydrophilic colloid layer, wherein at least one hydrophilic colloid layer is a silver halide photographic emulsion layer, and at least one hydrophilic colloid layer contains a compound represented by the general formula (I):

(I)

wherein $A_1$ and $A_2$ both represent hydrogen atoms, or one of them represents a hydrogen atom and the other represents a sulfonyl group or (wherein $R_0$ represents an alkyl group, an alkenyl group, an aryl group, an alkoxy group or an aryloxy group, and $l_1$ represents 1 or 2); G represents (wherein $m_1$ represents 1 or 2), $—SO_2—$, —SO—, (wherein $R_1$ represents an alkoxy group or an aryloxy group), a thiocarbonyl group or an iminomethylene group; X represents a substituted or unsubsituted aliphatic group, a substituted or unsubstituted aromatic group or a substituted or unsubstituted heterocyclic group; Y represents a divalent organic group; and Het represents a nitrogen containing heterocyclic aromatic group.

10 Claims, No Drawings

SILVER HALIDE PHOTOGRAPHIC MATERIAL

FIELD OF THE INVENTION

This invention relates to a silver halide photographic material which gives an extremely high contrast negative image, a high-sensitivity negative image and a dot image of good quality, and to a silver halide photographic material capable of forming direct positive image. More particularly, it relates to a photographic material which contains a novel compound as a nucleating agent for the silver halide.

BACKGROUND OF THE INVENTION

It is known to add hydrazine compounds to silver halide photographic emulsions or developing solutions. For example, the addition of hydrazine compounds to silver halide photographic emulsions or developing solutions is disclosed in U.S. Pat. No. 3,730,727 (developing solution containing a combination of ascorbic acid and hydrazine), U.S. Pat. No. 3,227,552 (the use of hydrazine as an auxiliary developing agent to obtain direct positive color image), U.S. Pat. No. 3,386,831 (silver halide light-sensitive material containing $\beta$-monophenylhydrazide of an aliphatic carboxylic acid as a stabilizer), U.S. Pat. No. 2,419,975 and Mees, *The Theory of Photographic Process*, the third edition, (1966), page 281.

In particular, U.S. Pat. No. 2,419,975 discloses a method for obtaining high contrast negative image by adding hydrazine compounds.

In the specification of that patent, it is disclosed that extremely high-contrast photographic characteristics having a gamma ($\gamma$) value exceeding 10 can be obtained when hydrazine compounds are added to silver chlorobromide emulsions, and when photographic materials are processed with developing solutions having a pH of as high as 12.8. However, strongly alkaline developing solutions having a pH near 13 are liable to be oxidized by air. They are therefore unstable and can not be stored or used over a long period of time.

Superhigh-contrast photographic characteristics having a gamma value exceeding 10 are useful for the reproduction of line drawing and for the photographic reproduction of continuous image by dot image useful for printing plate making in the case of both negative and positive images.

To achieve this object, there have been conventionally used methods wherein photographic emulsions comprising silver chlorobromide having a silver chloride content of higher than 50 mol %, preferably 75 mol % are used and development is carried out with hydroquinone developing solutions containing sulfite ion at an extremely low effective concentration (generally not higher than 0.1 mol/l). However, the low concentration of sulfite ion in the developing solutions results in the developing solutions being very unstable and being preserved for only 3 days at the most. Further, silver chlorobromide emulsions having a relatively high silver chloride content must be used and hence high sensitivity cannot be obtained. Accordingly, there has been a demand to obtain superhigh-contrast photographic characteristics useful for the reproduction of dot image or line drawing by using high-sensitivity emulsions and stable developing solutions.

U.S. Pat. Nos. 4,224,401, 4,168,977, 4,243,739, 4,272,614 and 4,323,643 disclose silver halide photographic emulsions which give extremely high-contrast negative photographic characteristics with stable developing solutions. However, it has been found that the acyl hydrazine compounds used therein have certain disadvantages.

Namely, it is known that these hydrazine compounds evolve nitrogen gas during development. The gas is accumulated in the film to form bubbles which damage the photographic image. Further, the gas flows into the developing solutions so that other photographic materials are adversely affected.

It is known that increasing the molecular weights of nucleating agents, to thereby make the agents nondiffusing, is a means for preventing gas from flowing into the developing solutions. However, it has been found that conventional nucleating agents which were made nondiffusing in this manner, reduce the stability of emulsions over time. Namely, when coating solutions containing those nucleating agents are left to stand, precipitates are formed in the coating solutions, filterability deteriorates and further photographic performance causes change.

Furthermore, these conventional hydrazine compounds must be used in large quantities for the purposes of sensitization and imparting high contrast. They also generally cause sensitization and an increase in fogging with time during storage when high-sensitivity photographic materials in particular are required and when the hydrazine compounds are used in combination with other sensitizing techniques (e.g., an increase in chemical sensitization; an increase in grain size; and the addition of compounds which accelerate sensitization as described in U.S. Pat. Nos. 4,272,606 and 4,241,164).

Accordingly, there has been a demand for compounds which reduce the evolution of bubbles or the outflow of gas into the developing solutions do not have a problem with respect to stability with time, and give extremely high contrast photographic characteristics by the use of a very small amount thereof.

U.S. Pat. Nos. 4,385,108, 4,269,929 and 4,243,739 disclose that extremely high contrast negative gradation photographic characteristics can be obtained by using hydrazine compounds having substituents which can be easily adsorbed by silver halide grains.

Among these hydrazine compounds having adsorptive groups, those exemplified in the above patent specifications have the disadvantage that they cause desensitization with time during storage. Hence, it is necessary to choose compounds which do not cause the above-described problem.

On the other hand, many direct positive photographic processes are known. Among them, the most useful are (1) a process wherein silver halide grains previously fogged are exposed in the presence of a desensitizer and then development is carried out and (2) a process wherein silver halide emulsions having sensitivity speck predominantly in the interior of silver halide grains are exposed and then development is carried out in the presence of a nucleating agent. The present invention relates to the latter process. A silver halide emulsion in which sensitivity speck exists predominantly in the interiors of silver halide grains and a latent image is predominantly formed in the interiors of the grains, is called an internal latent image type silver halide emulsion which can be distinguished from silver halide grains in which a latent image is predominantly formed on the surfaces of the grains.

There are known methods for obtaining direct positive image by subjecting the internal latent image type silver halide emulsion to surface development in the presence of a nucleating agent and photographic emulsions and photographic materials used for said methods, as disclosed in *Research Disclosure*, No. 23510 (November, 1983).

In the above methods for obtaining a direct positive image, nucleating agents may be added to developing solutions, but good reversal characteristics can be obtained when the nucleating agents are adsorbed on the surfaces of silver halide grains by adding the agents to the photographic emulsion layers of the photographic material or to the other appropriate layers thereof.

Examples of nucleating agents used in the above processes for obtaining a direct positive image are hydrazine compounds described in U.S. Pat. Nos. 2,563,785 and 2,588,982; hydrazide and hydrazine compounds described in U.S. Pat. No. 3,227,552; heterocyclic quaternary salt compounds described in U.S. Pat. Nos. 3,615,615, 3,719,494, 3,734,738, 4,094,683 and 4,115,122, British Patent 1,283,835, JP-A-52-3426 (the term "JP-A" as used herein means an "unexamined published Japanese patent application") and JP-A-52-69613; thio urea linking type acylphenyl hydrazine compounds described in U.S. Pat. Nos. 4,030,925, 4,031,127, 4,139,387, 4,245,037, 4,255,511 and 4,276,364 and British Patent 2,012,443; compounds having a heterocyclic thioamido group on the adsorption group described in U.S. Pat. No. 4,080,207; phenylacylhydrazine compounds having mercapto group-containing heterocyclic groups as the adsorption group described in British Patent 2,011,397B; sensitizing dyes having a substituent having a nucleating effect in the molecular structure described in U.S. Pat. No. 3,718,470; and hydrazine compounds described in JP-A-59-200230, JP-A-59-212828, JP-A-59-212829 and *Research Disclosure*, No. 3510 (November, 1983).

However, it has been found that all of these compounds have disadvantages. For example, some compounds are low in activity as a nucleating agent; those having high activity are poor in preservability; some compounds cause a change in activity between the time that the compound is added to the emulsion and the time that the emulsion is coated onto a support; and the quality of the layers deteriorates when large amounts of the compounds are added.

With the purpose of solving these problems, there have been proposed adsorption-type hydrazine derivatives described in JP-A-60-179734, JP-A-61-170733, JP-A-62-65034, JP-A-62-948, and JP-A-61-270744, hydrazine derivatives having a heterocyclic aromatic ring in the molecular structure described in JP-A-62-275247; and hydrazine derivatives having a modifying group described in JP-A-62-270948 and JP-A-63-29751. However, all of these compounds have disadvantages. For example, the nucleating activity is insufficient for the requirement of lowering the pH of processing solutions to increase the stability of developing solutions (namely to prevent developing agents from being deteriorated), and for the requirement of shortening the processing time of development to reduce dependence on variation of the composition of the developing solutions (e.g., pH, sodium sulfite). Or they cause an adverse effect by the outflow thereof into the developing solutions.

SUMMARY OF THE INVENTION

Accordingly, a first object of the present invention is to provide a silver halide photographic material which can give extremely high-contrast negative gradation photographic characteristics having a gamma value exceeding 10 with stable developing solutions.

A second object of the present invention is to provide a negative type silver halide photographic material containing a high-activity hydrazine compound which can give an extremely high-contrast negative gradation photographic characteristic even with developing solutions having a low pH value by the use of a small amount thereof without having an adverse effect on photographic characteristics.

A third object of the present invention is to provide a direct positive type silver halide photographic material containing a high-activity hydrazine compound which gives excellent reversal characteristics even with developing solutions having a low pH value.

A fourth object of the present invention is to provide a silver halide photographic material containing a hydrazine compound which can be easily synthesized, is excellent in preservability and has good long-term stability.

A fifth object of the present invention is to provide a silver halide photographic material which causes little change in activity during the production thereof and comprises emulsions having good long-term stability.

A sixth object of the present invention is to provide a silver halide photographic material in which the dependence on changes in developer composition is slight.

The above and other objects of the present invention have been realized by means of a silver halide photographic material having at least one hydrophilic colloid layer, wherein at least one hydrophilic colloid layer is a silver halide photographic emulsion layer, and at least one hydrophilic colloid layer contains a compound represented by the general formula (I):

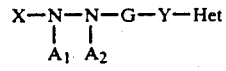

(I)

wherein $A_1$ and $A_2$ both represent hydrogen atoms, or one of them represents a hydrogen atom and the other represents a sulfonyl group or

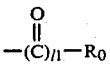

(wherein $R_0$ represents an alkyl group, an alkenyl group, an aryl group, an alkoxy group or an aryloxy group, and $l_1$ represents 1 or 2); G represents

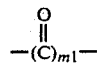

(wherein $m_1$ represents 1 or 2), $—SO_2—$, —SO—,

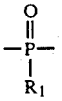

(wherein $R_1$ represents an alkoxy group having 1 to 20 carbon atoms or an aryloxy group having 6 to 20 carbon atoms), a thiocarbonyl group or an iminomethylene group; X represents a substituted or unsubstituted aliphatic group, a substituted or unsubstituted aromatic group or a substituted or unsubstituted heterocyclic group; Y represents a divalent organic group; and Het represents a nitrogen containing heterocyclic aromatic group.

DETAILED DESCRIPTION OF THE INVENTION

General formula (I) is described in detail below.

$A_1$ and $A_2$ in general formula (I) are hydrogen atoms, or one of them is an alkylsulfonyl group which has not more than 20 carbon atoms, an arylsulfonyl group (preferably an unsubstituted phenylsulfonyl group or a substituted phenylsulfonyl group of which the sum of the Hammett's substituent constants is at least −0.5), or $$-\overset{\overset{\displaystyle O}{\|}}{(C)}_l R_0$$

[where $R_0$ is preferably a linear chain, branched or cyclic alkyl group which has not more than 30 carbon atoms, an alkenyl group, an aryl group (preferably an unsubstituted phenyl group or a substituted phenyl group of which the sum of the Hammett's substituent constants is at least −0.5), an alkoxy group (for example, ethoxy), or an aryloxy group (which preferably has a single ring, for example phenyl), and these groups may have substituent groups, examples of which include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carboxamido group, a sulfonamido group and a nitro group]. Specific examples of sulfonyl groups which can be represented by $A_1$ and $A_2$ have been disclosed in U.S. Pat. No. 4,478,928.

$A_1$ and $A_2$ are most desirably hydrogen atoms.

Of the groups represented by G in general formula (I), $$-\overset{\overset{\displaystyle O}{\|}}{C}-$$

is preferred.

In general formula (I), the aliphatic groups represented by X are linear chain, branched or cyclic alkyl groups, alkenyl groups or alkynyl groups and these groups preferably have 1 to 20 carbon atoms.

The aromatic groups represented by X are monocyclic or bicyclic aryl groups, for example, a phenyl group or a naphthyl group. These aromatic groups preferably have 6 to 20 carbon atoms.

The heterocyclic rings represented by X are three to ten membered saturated or unsaturated heterocyclic rings which contain at least one carbon atom and at least one N, O or S atom. They may be single rings, or they may form condensed rings with other aromatic or heterocyclic rings. The heterocyclic rings preferably have 3 to 20 carbon atoms. The preferred heterocyclic rings are five or six membered aromatic heterocyclic groups. Those which contain a pyridyl group, an imidazolyl group, a quinolinyl group, a benzimidazolyl group, a pyrimidyl group, a pyrazolyl group, an isoquinolinyl group, a thiazolyl group or a benzthiazolyl group, for example, are preferred.

X is preferably an aromatic group, an aliphatic group or a group which can be represented by general formula (II):

$$X_b-(\underset{\displaystyle R_{b1}}{\underset{|}{C}}=\underset{\displaystyle R_{b2}}{\underset{|}{C}})_r-(\underset{\displaystyle R_{b3}}{\underset{|}{C}}=\underset{\displaystyle R_{b4}}{\underset{|}{C}})_s- \qquad \text{(II)}$$

wherein $X_b$ represents an aromatic group or a nitrogen containing heterocyclic group, $R_{b1}$–$R_{b4}$ each represents a hydrogen atom, a halogen atom or an alkyl group having 1 to 20 carbon atoms $X_b$ and $R_{b1}$–$R_{b4}$ may be substituted or unsubstituted, and r and s each represents 0 or 1.

X is more preferably an aromatic group, particularly an aryl group.

X may be substituted with substituent groups. Examples of substituent groups include an alkyl group, an aralkyl group, an alkenyl group, an alkynyl group, an alkoxy group, an aryl group, a substituted amino group, an aryloxy group, a sulfamoyl group, a carbamoyl group, a alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carboxamido group, a sulfonamido group and a nitro group, and also groups which can be represented by the general formula (III) indicated below:

$$R_{cl}-L-Y_c-\underset{\displaystyle R_{c2}}{\underset{|}{N}}- \qquad \text{(III)}$$

wherein $Y_c$ represents $$-\underset{\displaystyle O}{\underset{\|}{C}}-,\ -SO_2-,\ -\overset{\overset{\displaystyle O}{\|}}{\underset{\displaystyle R_{c3}}{\underset{|}{P}}}-$$

(wherein $R_{c3}$ represents an alkoxy group having 1 to 20 carbon atoms or an aryloxy group having 6 to 20 carbon atoms) or $$-O-\overset{\overset{\displaystyle O}{\|}}{\underset{\displaystyle R_{c3}}{\underset{|}{P}}}-$$

(wherein $R_{c3}$ is the same as defined above), and L represents a single bond, —O—, —S— or $$-\underset{\displaystyle R_{c4}}{\underset{|}{N}}-$$

(wherein $R_{c4}$ represents a hydrogen atom, an alkyl group having 1 to 20 carbon atoms or an aryl group having 6 to 20 carbon atoms). Of these substituent groups, those represented by the general formula (III) are preferred.

$R_{c1}$ and $R_{c2}$ each represents a hydrogen atom, an aliphatic group, an aromatic group or a heterocyclic group and they may be the same or different, and they may be joined together to form a ring.

Furthermore, X may be substituted by one or more units represented by the general formula (III) above.

In general formula (III), the aliphatic groups represented by $R_{c1}$ or $R_{c2}$ are linear chain, branched or cyclic alkyl groups, alkenyl groups or alkynyl groups.

The aromatic groups represented by $R_{c1}$ or $R_{c2}$ are single ring or double ring aryl groups, for example phenyl groups or naphthyl groups.

The heterocyclic groups of $R_{c1}$ or $R_{c2}$ are from three to ten membered saturated or unsaturated heterocyclic rings which contain at least one carbon atom and at least one N, O or S atom, and they may be single rings or they may form condensed rings with other aromatic or heterocyclic rings. The preferred heterocyclic rings are five or six membered aromatic heterocyclic rings and those which contain a pyridyl group, an imidazolyl group, a quinolinyl group, a benzimidazolyl group, a pyrimidyl group, a pyrazolyl group, an isoquinolinyl group, a thiazolyl group or a benzthiazolyl group are preferred.

$R_{c1}$ or $R_{c2}$ may be substituted with substituent groups. Examples of substituent groups are indicated below. These groups may be further substituted with substituent groups.

The substituent groups include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, a carboxyl group, an aryloxycarbonyl group, an acyl group, an alkoxycarbonyl group, an acyloxy group, a carboxamido group, a sulfonamido group and a nitro group.

These groups can be joined together to form a ring where that is possible.

Furthermore, $R_{c1}$ and $R_{c2}$ can be joined together to form a ring where that is possible.

$R_{c1}$ is preferably a substituted or unsubstituted alkyl, alkenyl, alkynyl, aryl or heterocyclic group, and $R_{c2}$ is preferably a hydrogen atom.

$Y_c$ in general formula (III) is most desirably $$-\underset{\underset{O}{\|}}{C}-$$

or $-SO_2-$, and L is preferably a single bond or $$-\underset{\underset{R_{c4}}{|}}{N}-.$$

The divalent organic groups represented by Y in general formula (I) are preferably aliphatic groups having 1 to 20 carbon atoms or aromatic groups having 3 to 20 carbon atoms.

The aliphatic groups represented by Y are linear chain, branched or cyclic alkylene groups, alkenylene groups or alkynylene groups.

The aromatic groups represented by Y are single ring or double ring arylene groups, for example phenylene groups or naphthylene groups, and phenylene groups are especially desirable.

Alkylene groups are preferred for Y, and substituted or unsubstituted methylene, ethylene and trimethylene are especially desirable.

Furthermore, Y may have substituent groups, and those mentioned as substituent groups for X can be cited as examples of preferred substituent groups for Y.

Het in general formula (I) is a nitrogen containing heterocyclic aromatic group. It may be, for example, a pyrrole group, a pyrazole group, an imidazole group, a triazole group, a tetrazole group, an oxazole group, an iso-oxazole group, an oxadiazole group, a thiazole group, a thiadiazole group, a pyridine group, a pyridazine group, a pyrimidine group, a pyrazine group, a triazine group, an indolidine group, an isoindole group, an indole group, an indazole group, a purine group, a quinoline group, an isoquinoline group, a benzimidazole group, a benzoxazole group or a benzothiazole group. Moreover, Het may be substituted or unsubstituted. The substituent groups cited above for X can be used as preferred examples of these substituent groups for Het.

Het preferably is an imidazole group, a pyridine group or a quinoline group, and an imidazole group is especially desirable.

In general formula (I), one or more of the groups X, Y and Het may have a group which promotes adsorption on silver halide.

Groups which promote adsorption on silver halide which can be substituted into X, Y and Het can be represented by $Z-(L_2)_t-$, wherein Z is a group which promotes adsorption of silver halide and $L_2$ is a divalent linking group. Moreover, t represents 0 or 1.

Thioamido groups, mercapto groups and groups which have disulfide bonds, or five or six membered nitrogen containing heterocyclic groups, are preferred examples of the groups which promote adsorption on silver halide which can be represented by Z.

The thioamido groups which promote adsorption which can be represented by Z are divalent groups which can be represented by $$-\overset{\overset{S}{\|}}{C}\text{-amino-}.$$

This thioamido group may be in the form of a ring structure or it may be non-cyclic thioamido group. Useful thioamido groups which promote adsorption can be selected from among those disclosed, for example, in U.S. Pat. Nos. 4,030,925, 4,031,127, 4,080,207, 4,245,037, 4,255,511, 4,266,013 and 4,276,364, in *Research Disclosure,* Volume 151, No. 15162 (November, 1976), and in ibid, Volume 176, No. 17626 (December, 1978).

Specific examples of non-cyclic thioamido groups include thioureido groups, thiourethane groups and dithiocarbamic acid ester groups, and specific examples of cyclic thioamido groups include 4-thiazolin-2-thione, 4-imidazolin-2-thione,2-thiohydantoin, rhodanine,thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione and benzothiazolin-2-thione. These groups may be further substituted.

The mercapto groups represented by Z ar aliphatic mercapto groups, aromatic mercapto groups or heterocyclic mercapto groups (those where there is a nitrogen atom adjacent to the carbon atom to which the —SH group is bonded correspond to the cyclic thioamido group to which they are related tautomerically, and examples of such groups are the same as those described above in connection with the thioamido groups).

Five or six membered nitrogen containing rings comprised of at least one carbon atom and at least one atom selected from nitrogen, oxygen and sulfur can be cited as the five or six membered nitrogen containing heterocyclic groups which can be represented by Z. Of these groups, the preferred groups include, for example, benzotriazole, triazole, tetrazole, indazole, benzimidazole, imidazole, benzothiazole, thiazole, benzoxazole, oxazole, thiadiazole, oxadiazole and triazine.

The substituent groups mentioned above for X can be cited here as substituent groups for Z. Of the groups which can be represented by Z, the cyclic thioamido groups (which is to say the mercapto substituted nitrogen containing heterocyclic groups, for example, the 2-mercaptothiadiazole, 3-mercapto-1,2,4-triazole, 5-mercaptotetrazole, 2-mercapto-1,3,4-oxadiazole and 2-mercaptobenzoxazole groups), or the nitrogen containing heterocyclic groups (for example, the benzotriazole, benzimidazole and indazole groups) are preferred. Furthermore, two or more $Z—(L_2)_l—$ groups may be substituted, and they may be the same or different.

The divalent linking group represented by $L_2$ is an atom or a group of atoms containing at least one member of the group C, N, S and O. Specific examples include alkylene groups, alkenylene groups, alkynylene groups, arylene groups, —O—, —S—, —NH—, —N=, —CO—and —$SO_2$—, and these groups may have substituent groups. These groups may be used individually, or the linking group may be comprised of a combination of these groups.

Specific examples include

—CONH—, —NHCONH—, —$SO_2$NH—, —COO—,

—NHCOO—, 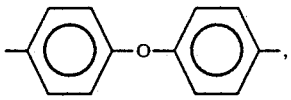 ,

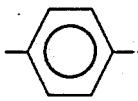 —$CONCH_2CH_2$—, —$CH_2$—, $+CH_2+_2$, $+CH_2+_3$, 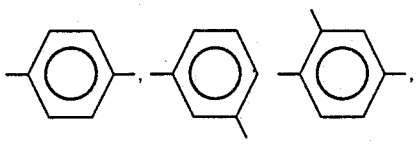 ,

-continued

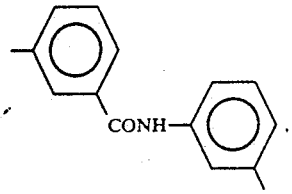

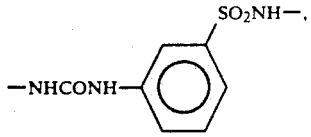

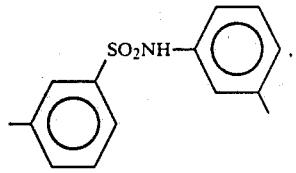

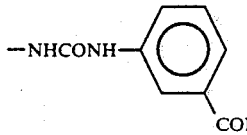

CONH—, NHCONH$CH_2CH_2$CONH—.

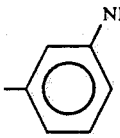

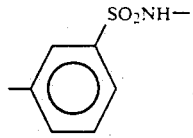

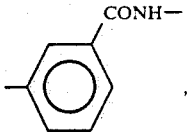

—$CH_2CH_2SO_2$NH— and —$CH_2CH_2$CONH—.

These may be substituted with appropriate substituent groups. The substituent groups mentioned above for X can be cited as substituent groups for $L_2$.

Furthermore, the ballast groups normally used in immobile photographically useful additives, such as couplers for example, can also be included in X, Y or Het.

Ballast groups are organic groups having 1 to 40 carbon atoms, which provide a molecular weight which is sufficient to render the compound represented by general formula (I) essentially unable to diffuse into other layers or into processing solutions. Ballast groups may be, for example, alkyl groups, aryl groups, heterocyclic groups, ether groups, thioether groups, amido groups, ureido groups, urethane groups, or sulfonamido groups, or combinations of these groups. Ballast groups which have substituted benzene rings are preferred, and those which have benzene rings substituted with branched alkyl groups are especially desirable.

Specific examples of compounds which can be represented by general formula (I) are indicated below as Compounds 1 to 31. However, the invention is not limited to these compounds.

1.
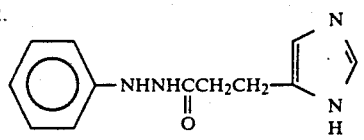
2.
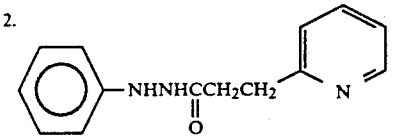
3.
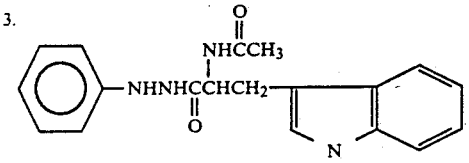
4.
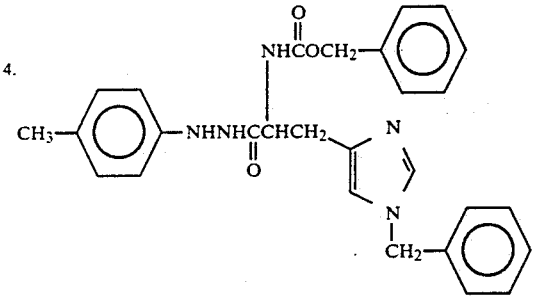
5.
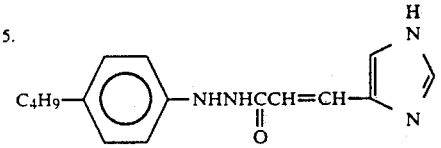
6.
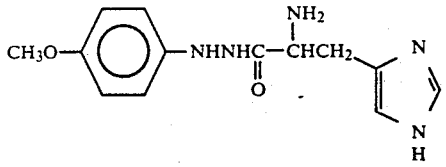
7.
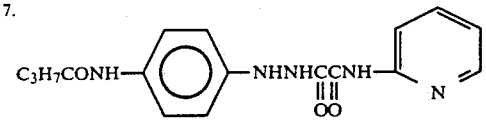
8.
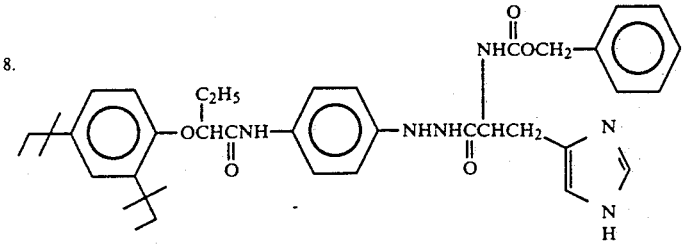

-continued
9.
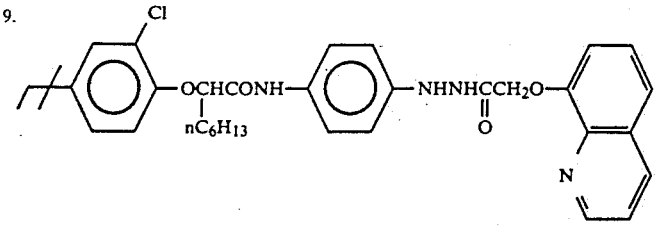
10.
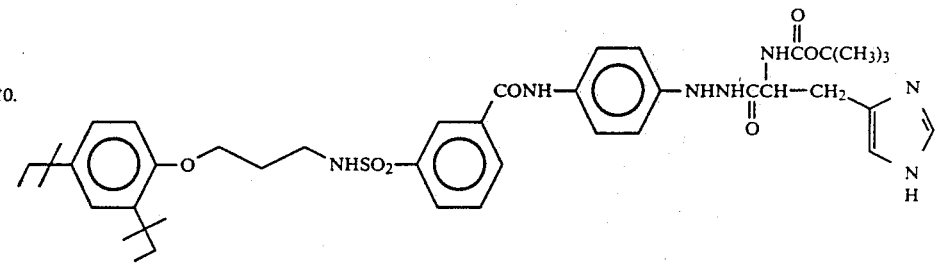
11.
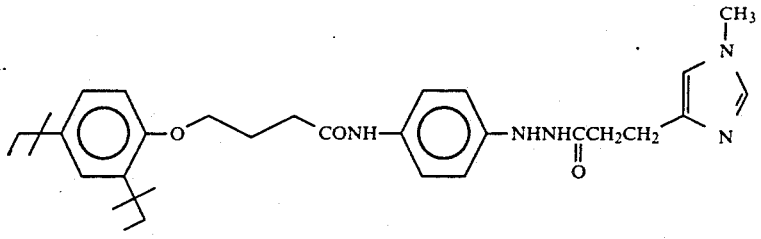
12.
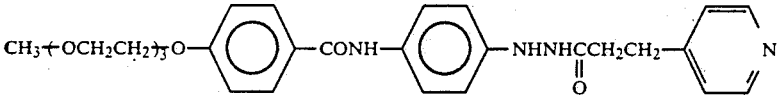
13.
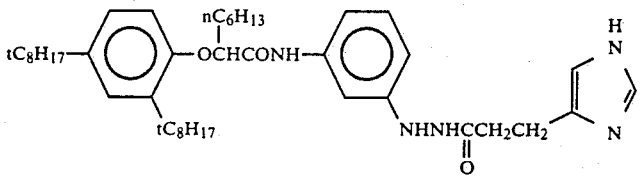
14.
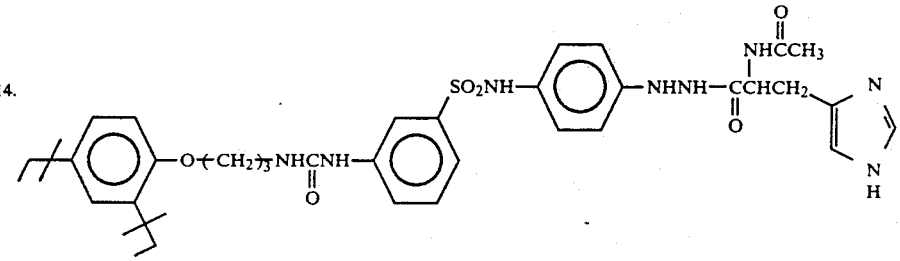
15.
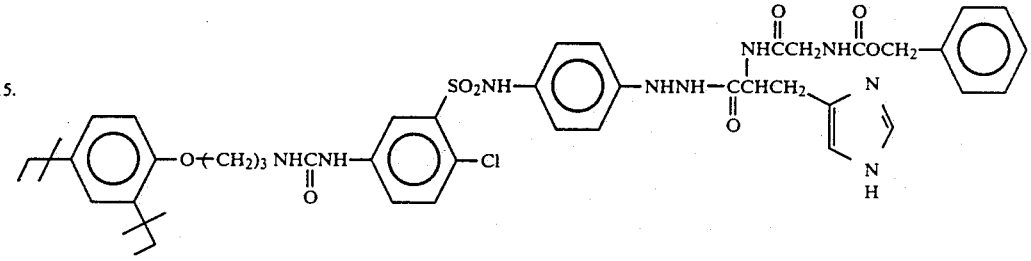

-continued
16.
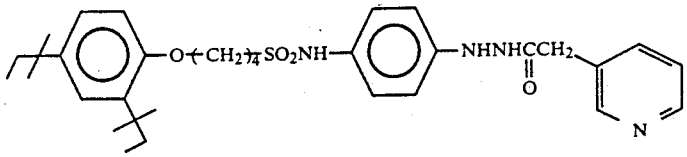
17.
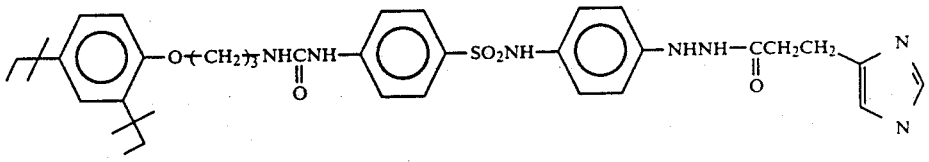
18.
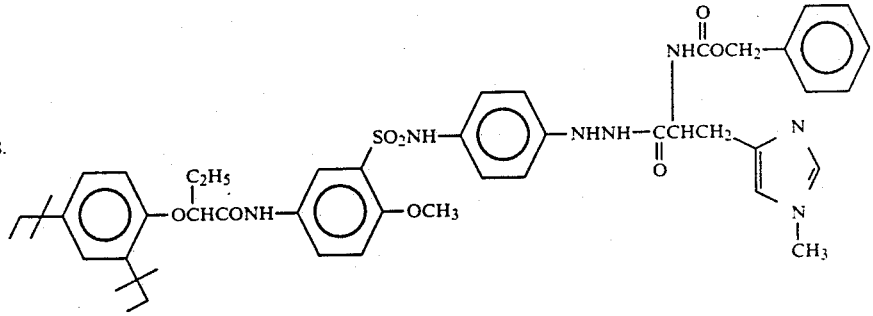
19.
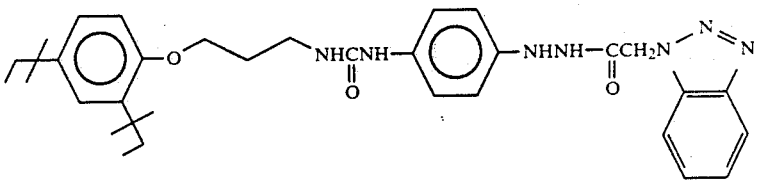
20.
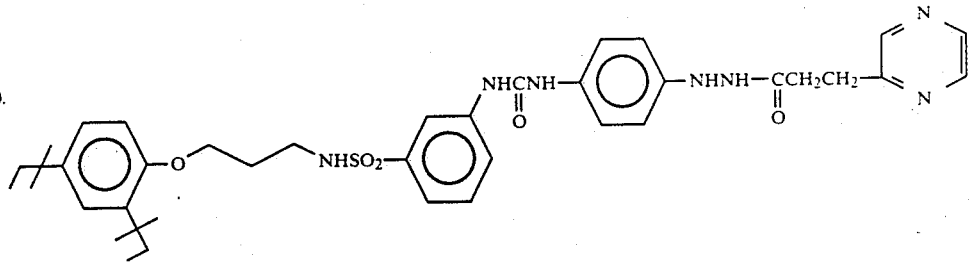
21.
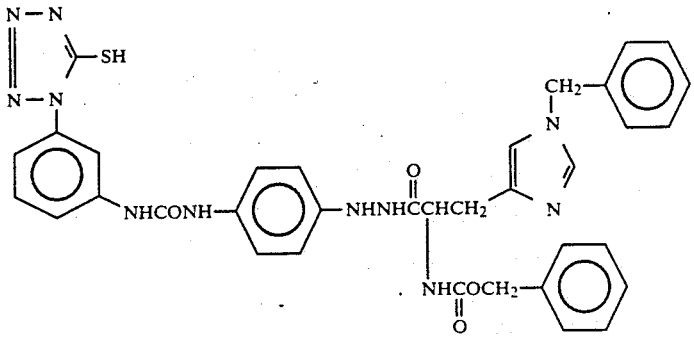

-continued
22.
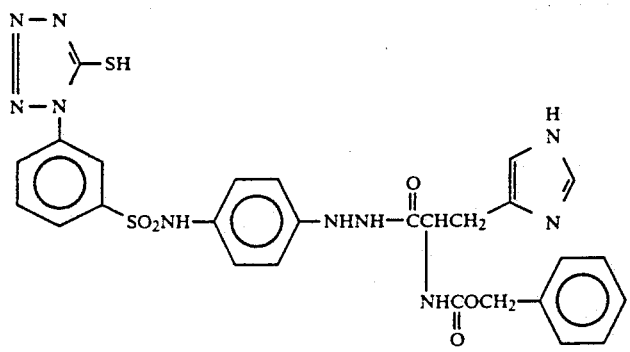
23.
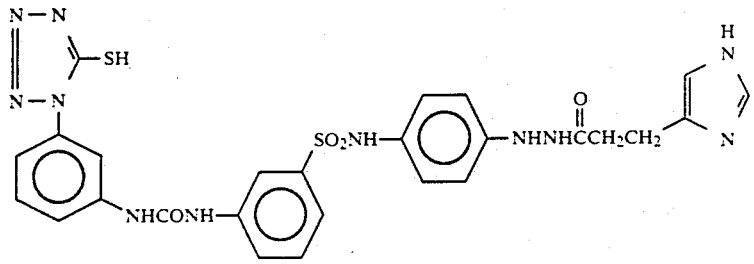
24.
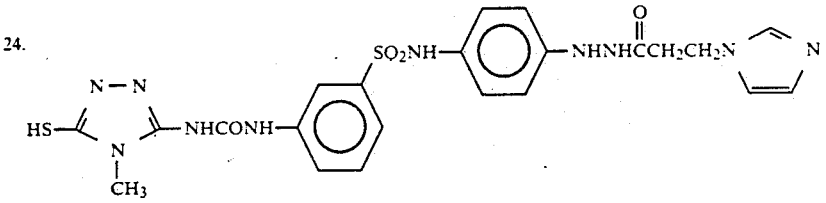
25.
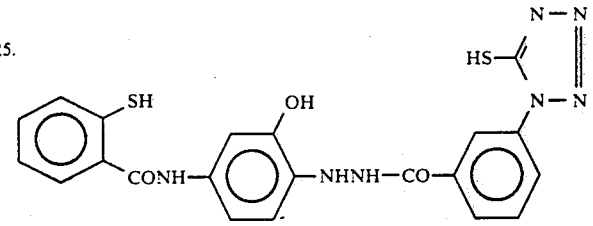
26.
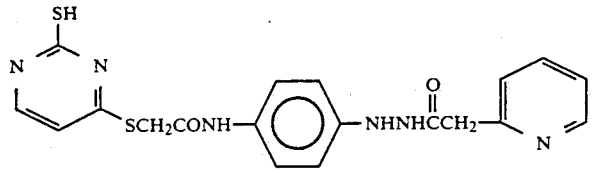
27.
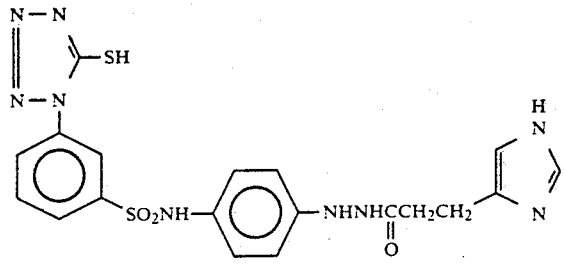

-continued

28.

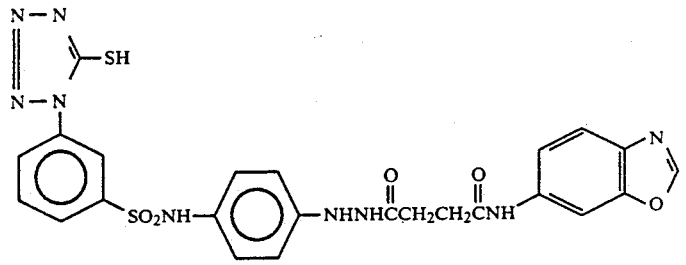

29.

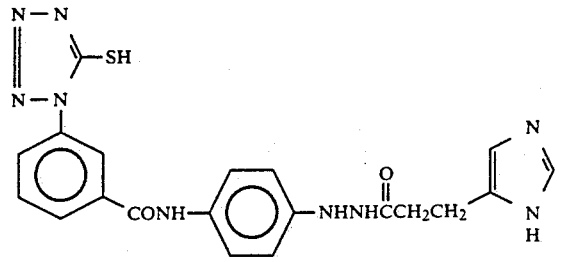

30.

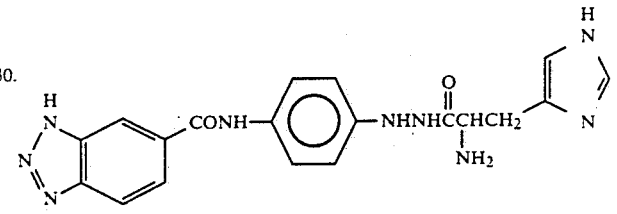

31.

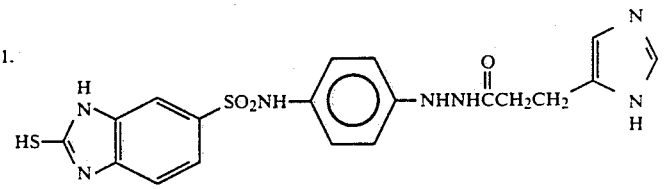

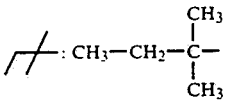

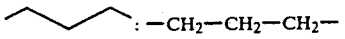

The hydrazine compounds of formula (I) of the present invention can be prepared by reacting the corresponding hydrazine with the corresponding carboxylic acid in the presence of a condensing agent such as dicyclohexylcarbodiimide for example, or by reacting the corresponding hydrazine with an activated carboxylic acid, such as an acylamide, an acyl chloride or an acid anhydride.

Typical examples of synthesis are described below.

SYNTHESIS EXAMPLE 1

Preparation of Compound 4

Z-His(Bzl)-OH (3.8 grams), 2,4,5-trichlorophenol (2.4 grams) and dicyclohexylcarbodiimide (2.1 grams) were reacted for 12 hours at room temperature in DMF (25 ml). The insoluble material was removed by filtration, after which p-tolylhydrazine hydrochloride (1.8 grams) and triethylamine (1.4 ml) were added and the mixture was reacted for a further period of 24 hours at room temperature. The volatile material was removed under reduced pressure and the target compound was obtained by refining the residue using silica gel chromatography (Recovery 3.2 grams). The chemical structure was confirmed using NMR spectroscopy and IR spectroscopy, and by elemental analysis.

SYNTHESIS EXAMPLE 2

Preparation of Compound 8

Concentrated hydrochloric acid (4 ml) was added to a mixture of the compound indicated below (10.2 grams) and methanol (50 ml) and the mixture was stirred overnight at room temperature. After removing the volatile components completely under reduced pressure, ethyl acetate (50 ml) and triethylamine (3 ml) were added. Moreover, an ethyl acetate solution (10 ml) of Z-His-$N_3$ (which was prepared in the usual way from Z-His-$NHNH_2$ (8 grams)) was added and the mixture was stirred for 20 hours at room temperature. The volatile components were once more removed under reduced pressure and the target compound was obtained from the residue on refining with silica gel chromatography (recovery 4.6 grams). The chemical structure was confirmed using NMR spectroscopy and IR spectroscopy, and by elemental analysis.

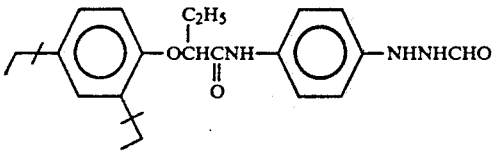

Other compounds of formula (I) can be prepared using similar methods.

The compounds of formula (I) of the present invention may be contained in any hydrophilic colloid layer of the photographic material.

The compounds of formula (I) of the present invention are dissolved in water or in a water miscible organic solvent (salts can be formed by adding an alkali hydroxide or a tertiary amine, as required, to achieve solution), after which the solution may be added to a hydrophilic colloid solution (for example, a silver halide emulsion or an aqueous gelatin solution) (the pH may be adjusted by the addition of acid or alkali, as required, at this time) for inclusion in the photographic emulsion layer or in another hydrophilic colloid layer.

The compounds of formula (I) of the present invention may be used individually, or two or more compounds can be used conjointly. The amount of the compounds of formula (I) of the present invention added to the emulsion layer or another hydrophilic colloid layer is preferably from $1\times10^{-6}$ mol to $5\times10^{-2}$ mol, and most desirably from $1\times10^{-5}$ mol to $1\times10^{-2}$ mol, per mol of silver halide. A suitable amount is selected based on the nature of the silver halide emulsion in which they are combined.

The compounds of the present invention represented by general formula (I) can be used in combination with negative type emulsions to form high contrast negative images. On the other hand, they can be used in combination with internal latent image type silver halide emulsions.

In those cases where these compounds are used to form high contrast negative images, the average grain size of the silver halide which is used is preferably small (for example, not more than 0.7 μm), and it is most desirably not more than 0.5 μm. Fundamentally, no limitation is imposed on the grain size distribution, but mono-dispersions are preferred. Here, a mono-dispersion signifies that the emulsion is comprised of grains such that at least 95% of the grains by weight, or in terms of the number of grains, are of a size within ±40% of the average grain size.

The silver halide grains in the photographic emulsion may have a regular crystalline form such as a cubic, octahedral, rhombo-dodecahedral or tetradecahedral form, or they may have an irregular crystalline form such as a spherical or tabular form. Alternatively, they may have a crystalline form which is a composite of these forms.

The silver halide emulsions used in the present invention may have any composition, for example that of silver chloride, a silver chlorobromide, a silver iodobromide or a silver iodochlorobromide.

The silver halide grains may be such that the interior and the surface layer are comprised of a uniform phase, or the interior and the surface layer may be comprised of different phases.

Cadmium salt, sulfite, lead salt, thallium salt, rhodium salt or its complex salt, or iridium salt may be allowed to coexist during the formation of silver halide grains or during physical ripening in the preparation of the silver halide emulsions of the present invention.

The silver halide emulsions of the present invention may or may not be subjected to chemical sensitization. As methods for the chemical sensitization of the silver halide emulsions, there are known sulfur sensitization, reduction sensitization and noble metal sensitization. These methods may be used either alone or in combination to carry out chemical sensitization.

A typical noble metal sensitization is the gold sensitization method using gold compounds, mainly gold complex. Noble metals such as complex salts of platinum, palladium and rhodium other than gold may be used. Examples thereof are described in U.S. Pat. No. 2,448,060 and British Patent 618,016. Various sulfur compounds such as thiosulfates, thioureas, thiazoles and rhodanine in addition to sulfur compounds contained in gelatin can be used as the sulfur sensitizing agent.

It is preferred that iridium salt or rhodium salt is used before the completion of physical ripening, particularly during the formation of grains in the preparation of the silver halide emulsions.

It is preferred from the viewpoint of elevating maximum density (Dmax) that the silver halide emulsion layers of the present invention contain two kinds of monodispersed emulsions having different mean grain sizes as is described in JP-A-61-223734 and JP-A-62-90646. It is preferred that smaller-size monodispersed grains are chemically sensitized. Sulfur sensitization is most preferred as chemical sensitization. Larger-size monodispersed grains need not be chemically sensitized. However, the grains may be chemically sensitized. Since larger-size monodispersed grains are liable to form black peppers, the grains are generally not chemically sensitized. However, when chemical sensitization is carried out, it is particularly preferred that chemical sensitization is conducted only to such a slight extent that black peppers are not yet formed. The term "slight extent" as used herein means that chemical sensitization is carried out by shortening chemical sensitization time, lowering the temperature of chemical sensitization or reducing chemical sensitizing agents to be added in comparison with the chemical sensitization of smaller-size grains. Though there is no particular limitation with regard to a difference in sensitivity between a larger-size monodispersed emulsion and a smaller-size monodispersed emulsion, the difference is preferably 0.1 to 1.0, more preferably 0.2 to 0.7 in terms of ΔlogE. It is preferred that the larger-size monodispersed emulsion has higher sensitivity than that of the smaller-size monodispersed emulsion. The sensitivity of each emulsion is obtained by coating a support with the emulsion containing the hydrazine derivative and processing it with a developing solution having a pH of 10.5 to 12.3 and containing a sulfite ion at a concentration of at least 0.15 mol/l. The mean grain size of small-size monodispersed grains is not larger than 90%, preferably not larger than 80% of that of larger-size monodispersed grains. The mean grain size of silver halide emulsion grains is preferably 0.02 to 1.0 μm, more preferably 0.1 to 0.5 μm. It is preferred that the mean grain sizes of both the smaller-size and larger-size grains are in the range described above.

When two or more emulsions having different grain sizes are used in the present invention, the coating weight (in terms of silver) of the smaller-size monodispersed emulsion is preferably 40 to 90 wt %, more preferably 50 to 80 wt % based on the total coating weight of silver.

In the present invention, monodispersed emulsions having different grain sizes may be introduced into the same emulsion layer or into separate layers. When they are introduced into separate layers, it is preferred that the larger-size emulsion is introduced into the upper layer and the smaller-size emulsion is introduced into the lower layer.

The total coating weight of silver is preferably $g/m^2$ to 8 $g/m^2$.

Sensitizing dyes (e.g., cyanine dyes, merocyanine dyes, etc.) described in JP-A-55-52050 (pages 45 to 53) can be added to the photographic materials of the present invention to increase sensitivity. These sensitizing dyes may be used either alone or in combination. The combinations of the sensitizing dyes are often used for the purpose of supersensitization in particular. In addition to the sensitizing dyes, emulsions may contain a dye which itself does not have spectral sensitization effect, or a material which does not substantially absorb visible light but does exhibit supersensitizing activity. Useful sensitizing dyes, combinations of dyes for the purpose of supersensitization and materials exhibiting supersensitization are described in *Research Disclosure,* Vol. 176, No. 17643 (December, 1978), page 23, item IV-J.

The photographic materials may contain various compounds to prevent fogging from being caused during the manufacturing process and during storage of the photographic materials or during processing or to stabilize photographic performance. Namely, compounds known as antifogging agents or stabilizers such as azoles, for example, benzthiazolium salts, nitroindazoles, chlorobenzimidazoles, bromobenzimidazoles, mercaptothiazoles, mercaptobenzthiazoles, mercaptothiadiazoles, aminotriazoles, benzthiazoles and nitrobenzotriazoles; mercaptopyrimidines; mercaptotriazines; thioketo compounds, for example, oxazolinethione; azaindenes, for example, triazaindenes, tetraazaindenes (particularly, 4-hydroxy-substituted(1,3,3a,7)tetraazaindenes); pentaazaindenes; and benzenethiosulfonic acid and benzenesulfinic acid benzenesulfonamide can be added. Among them, benzotriazoles (e.g., 5-methyl benzotriazole) and nitroindazoles (e.g., 5-nitroindazole) are preferred. Alternatively, these compounds may be incorporated in processing solutions.

As development accelerators or accelerators for nucleating infectious development in the present invention, compounds described in JP-A-53-77616, JP-A-54-37732, JP-A-53-137133, JP-A-60-140340 and JP-A-60-14959 and nitrogen- or sulfur-containing compounds can be effectively used.

The optimum amount of these accelerators varies depending on the type of compound, but they are generally used in an amount of $1.0\times10^{-3}$ to 0.5 $g/m^2$, preferably $5.0\times10^{-3}$ to 0.1 $g/m^2$.

The photographic emulsion layers and other hydrophilic colloid layers of the photographic material of the present invention may contain desensitizers.

Organic desensitizers used in the present invention are determined by polarographic half wave potential, (namely, oxidation-reduction potential determined by polarography) and are those wherein the sum of the polarographic anode potential and cathode potential is positive. A method for measuring oxidation-reduction potential by polarography is described in, for example, U.S. Pat. No. 3,501,307. It is preferred that the organic desensitizers have at least one water-soluble group such as a sulfonic acid group or a carboxyl group. These groups may form a salt with an organic base (e.g., ammonia, pyridine, triethylamine, piperidine, morpholine, etc.) or an alkali metal (e.g., sodium, potassium, etc.).

Preferable organic desensitizers used in the present invention include compounds represented by the following formulae (IV) to (VI):

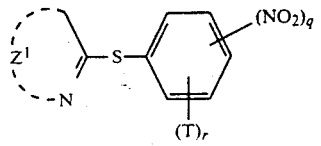

(IV)

wherein T represents an alkyl group, a cycloalkyl group, an alkenyl group, a halogen atom, a cyano group, a trifluoromethyl group, an alkoxy group, an aryloxy group, a hydroxy group, an alkoxycarbonyl group, a carboxyl group, a carbamoyl group, a sulfamoyl group, an aryl group, an acylamino group, a sulfonamido group, a sulfo group or a benzocondensed ring, which may or may not have one or more substituents; $Z_1$ represents a group of nonmetal atoms required to complete a nitrogen-containing heterocyclic ring, which may or may not have one or more substituents; q is 1, 2 or 3; and r is 0, 1 or 2.

Specific examples of nitrogen-containing heterocyclic rings completed through $Z_1$ include a 1,2,4-triazole ring, a 1,3,4-oxadiazole ring, a 1,3,4-thiadiazole ring, a tetraazaindene ring, a pentaazaindene ring, a triazaindene ring, a benzothiazole ring, a benzimidazole ring, a benzoxazole ring, a pyrimidine ring, a triazine ring, a pyridine ring, a quinoline ring, a quinazoline ring, a phthalazine ring, a quinoxaline ring, an imidazo[4,5-b]quinoxaline ring, a tetrazole ring and a 1,3-diazaazulene ring, which may or may not have one or more substituents or may be fused with one or more additional aromatic rings.

Formula (V) is as follows:

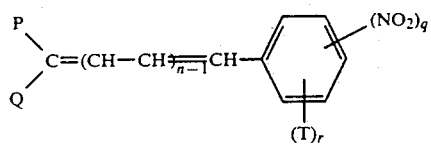

(V)

wherein P and Q, which may be the same or different, each represents a cyano group, an acyl group, a thioacyl group, an alkoxycarbonyl group, an alkylsulfonyl group, an arylsulfonyl group, a substituted or unsubstituted sulfamoyl group, a substituted or unsubstituted carbamoyl group, a nitro group, or a substituted or unsubstituted aryl group; n is 1,2 or 3; and T, r and q have the same meaning as defined in formula (IV) above; and formula (VI) is as follows:

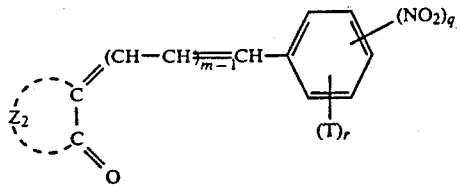

(VI)

wherein $Z_2$ represents a group of nonmetal atoms required to complete a ketomethylene ring; m is 1, 2 or 3; and T, r and q have the same meaning as defined in formula (IV) above.

Specific examples of ketomethylene rings completed through $Z_2$ include a pyrazolone ring, an isoxazolone ring, an oxindol ring, a barbituric ring, a thiobarbituric ring, a rhodanine ring, an imidazo[1,2-a]pyridone ring, a 2-thio-2,4-oxazolidinedione ring, a 2-thio-2,5-thiazolidinedione ring, a thiazolidone ring, a 4-thiazolone ring, a 2-imino-2,4-oxazolinone ring, a 2,4-imidazolinedione ring (a hydantoin ring), a 2-thiohydantoin ring and a 5-imidazolone ring., The organic desensitizers are allowed to exist in an amount of $1.0\times10^{-8}$ to $1.0\times10^{-4}$ mol/m$^2$, particularly preferably $1.0\times10^{-7}$ to $1.0\times10^{-5}$ mol/m$^2$, in the silver halide emulsion of the present invention.

The emulsion layers and other hydrophilic colloid layers of the present invention may contain water-soluble dyes as filter dyes or for the purposes of irradiation prevention, etc. As the filter dyes, there are used dyes for lowering photographic sensitivity, preferably ultraviolet absorbers having a spectral absorption maximum in the region of sensitivity inherent in silver halide or dyes having light absorption in the region of mainly 380 nm to 600 nm to enhance safety to safelight in handling the photographic material as a daylight material.

Preferably, these dyes are added to the emulsion layers, or these dyes together with a mordant are added to the area above the silver halide emulsion layers. In other words, the dyes and the mordant are added to the light-insensitive hydrophilic colloid layer which is farther away from the support than the silver halide emulsion layer. After such addition the dyes are fixed.

The amounts of the dyes to be used vary depending on the molar absorption coefficient of the ultraviolet light absorber, but the dyes are generally used in an amount of $10^{-2}$ to 1 g/m$^2$, preferably 50 to 500 mg/m$^2$.

The above-described ultraviolet light absorbers are dissolved in an appropriate solvent [e.g., water, alcohol (e.g., methanol, ethanol, propanol, etc.), acetone, methyl cellosolve, etc. or a mixture thereof] and are then added to coating solutions.

As the ultraviolet light absorbers, there can be used aryl group-substituted benzotriazole compounds, 4-thiazolidone compounds, benzophenone compounds, cinnamic ester compounds, butadiene compounds, benzoxazole compounds and ultraviolet light absorbing polymers.

Examples of the ultraviolet light absorbers are described in U.S. Pat. Nos. 3,533,794, 3,314,794 and 3,352,681, JP-A-46-2784, U.S. Pat. Nos. 3,705,805, 3,707,375, 4,045,229, 3,700,455 and 3,499,762 and West German Patent Publication No. 1,547,863.

Examples of the filter dyes include oxonol dyes, hemioxonol dyes, styryl dyes, merocyanine dyes, cyanine dyes and azo dyes. Water-soluble dyes or dyes which can be decolorized by alkalies or sulfite ions are preferred from the viewpoint of reducing the formation of after-color after developing.

Examples of the dyes include pyranzolone oxonol dyes described in U.S. Pat. No. 2,274,782; diaryl azo dyes described in U.S. Pat. No. 2,956,879; styryl dyes and butadiene dyes described in U.S. Pat. Nos. 3,423,207 and 3,384,487; merocyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and dyes described in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

The dyes are dissolved in an appropriate solvent [e.g., water, alcohol (e.g., methanol, ethanol, propanol, etc.), acetone, methyl cellosolve, etc. or a mixture thereof] and are then added to coating solutions for the light-insensitive hydrophilic colloid layers of the present invention.

Specifically, the dyes are used in an amount of generally $10^{-3}$ to 1 g/m$^2$, particularly preferably $10^{-3}$ to 0.5 g/m$^2$.

The photographic emulsion layers and other hydrophilic colloid layers of the photographic material of the present invention may contain inorganic or organic hardening agents such as chromium salts, aldehydes (e.g., formaldehyde, glutaraldehyde, etc.), N-methylol compounds (e.g., dimethylol urea), active vinyl compounds (e.g., 1,3,5-triacryloyl-hexahydro-s-triazine, 1,3-vinylsulfonyl-2-propanol), active halogen compounds (e.g., 2,4-dichloro-6-hydroxy-s-triazine), mucohalogen acids, etc. These compounds may be used either alone or in combination.

The photographic emulsion layers or other hydrophilic colloid layers of the photographic material of the present invention may contain surfactants as a coating aid or to impart antistatic properties, improve sliding properties and emulsified dispersion, prevent adhesion or improve photographic characteristics (e.g., development acceleration, sensitization and high contrast). Particularly preferred examples of surfactants which can be used in the present invention are polyalkylene oxides having a molecular weight of not less than 600 which are described in JP-B-58-9412 (the term "JP-B" as used herein means an "examined Japanese patent publication"). When the surfactants are to be used as antistatic agents, fluorine-containing surfactants (in detail described in U.S. Pat. No. 4,201,586, JP-A-60-80849, JP-A-59-74554) are particularly preferred.

The photographic emulsion layers and other hydrophilic colloid layers of the photographic material of the present invention may contain a matting agent such as silica, magnesium oxide or polymethyl methacrylate to prevent adhesion.

The photographic emulsions of the present invention may contain a dispersion of a water-insoluble or sparingly water-soluble synthetic polymer to improve dimensional stability. For this purpose, there can be used, for example, polymers of alkyl (meth)acrylates, alkoxyalkyl (meth)acrylates, glycidyl (meth)acrylates, etc., singly or a mixture thereof, or copolymers thereof with a monomer component such as acrylic acid of methacrylic acid.

It is preferred to inhibit the occurrence of black pepper fog that the silver halide emulsion layers and other layers of the photographic material of the present invention contain a compound having an acid group. Examples of compounds having an acid group includes organic acids such as salicylic acid, acetic acid and ascorbic acid and polymers having a repeating unit of an acid monomer such as acrylic acid, maleic acid, phthalic acid or the like or copolymers of these monomers. These compounds are described in JP-A-61-223 834, JP-A-61-228437, JP-A-62-25745 and JP-A-62-55642. Among them, a particularly preferred low-molecular compound is ascorbic acid. There are particularly preferred water-dispersible latexes of copolymers of an acid monomer such as acrylic acid with a cross-linking monomer having two or more unsaturated groups such as divinyl benzene as high-molecular weight compounds.

Stable developing solutions can be used to obtain superhigh-contrast, high-sensitivity photographic characteristics by using the silver halide photographic material of the present invention without using conventional infectious developing solutions or highly alkaline developing solutions having a pH near 13 as described in U.S. Pat. No. 2,419,975.

The silver halide photographic materials of the present invention give sufficiently superhigh-contrast negative images by using developing solutions having a pH of 10.5 to 12.3, particularly 11.0 to 12.0 and containing a sulfite ion as preservative at a concentration of not less than 0.15 mol/l.

Though there are no particular limitations with respect to developing agents used in the developing solutions of the present invention, it is preferred from the viewpoint of easily obtaining halftone dots of good quality that dihydroxybenzenes are present. Combinations of dihydroxybenzenes and 1-phenyl-3-pyrazolidones or combinations of dihydroxybenzenes and p-aminophenols may also be used. The developing agents are used in an amount of preferably 0.05 to 0.8 mol/l. When combinations of dihydroxybenzenes and 1-phenyl-3-pyrazolidones or p-aminophenols are used, the former is used in an amount of 0.05 to 0.5 mol/l and the latter is used in an amount of preferably not more than 0.06 mol/l.

Sulfite preservatives which are used in the present invention include sodium sulfite, potassium sulfite, lithium sulfite, ammonium sulfite, sodium bisulfite, potassium metabisulfite and formaldehyde-sodium bisulfite. The sulfites are used in an amount of not less than 0.4 mol/l, particularly preferably not less than 0.5 mol/l.

Compounds described in JP-A-56-24347 can be used as silver stain inhibitors in the developing solutions of the present invention. Compounds described in JP-A-61-267759 can be used as dissolution aids to be added to the developing solutions. Compounds described in JP-A-60-93433 or JP-A-62-186259 can be used as pH buffer agents to be used for the developing solutions.

Specific examples of the silver stain inhibitors are as follows.

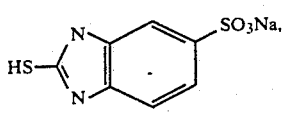

-continued

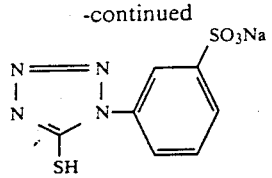

Specific examples of the dissolution aid include p-toluene sulphonic acid sodium salt, and specific examples of the pH buffer agents include borate, 5-sulfosalicylic acid and phosphate.

The compounds of formula (I) can be used in combination with negative type emulsions to give high-contrast photographic materials as described above. In addition thereto, the compounds can be used in combination with internal latent image type silver halide emulsions. Embodiments therefor are illustrated below. It is preferred that the compounds having the formula (I) are incorporated in the internal latent image type silver halide emulsion layers. However, the compounds may be incorporated in hydrophilic colloid layers adjacent to the internal latent image type silver halide emulsion layers. Such layers include a coloring material layer, an interlayer, a filter layer, a protective layer and an antihalation layer. The layers may be those having any function, so long as interference with the diffusion of the nucleating agents in silver halide grains does not occur.

It is desirable that the contents of the compounds having the formula (I) in the layers are in an amount to give sufficient maximum density (e.g., at least 1.0 in terms of silver density) when the internal latent image type emulsions are developed with surface developing solutions. Practically, the contents vary depending on the characteristics of the silver halide emulsions to be used, the chemical structures of the nucleating agents and developing conditions. Hence, suitable contents vary widely, but the contents of the compounds are practically in the range of about 0.005 mg to 500 mg per mol of silver in the internal latent image type silver halide emulsion, preferably in the rang of about 0.01 mg to about 100 mg per mol of silver. When the compounds are to be incorporated in the hydrophilic colloid layers adjacent to the emulsion layers, the same amount as that described above in connection with the amount of silver contained in the same area as that of the internal latent image type emulsion layer may be incorporated. The definition of the internal latent image type silver halide emulsion is described in JP-A-61-170733 (page 10, upper column) and British Patent 2,089,057 (pages 18 to 20).

Preferred internal latent image type emulsions which can be used in the present invention are described in JP-A-63-108336 (page 28, line 14 to page 31, line 2) which corresponds to European Patent Application 267482A and preferred silver halide grains are described in JP-A-63-108336 (page 31, line 3 to page 32, line 11).

The internal latent image type emulsions of the photographic material of the present invention may be spectral-sensitized to relatively long-wave blue light, green light, red light or infrared light by using sensitizing dyes. Examples of the sensitizing dyes which can be used include cyanine dyes, merocyanine dyes, complex cyanine dyes, complex merocyanine dyes, holopolar cyanine dyes, styryl dyes, hemicyanine dyes, oxonol dyes and hemioxonol dyes. Cyanine dyes and merocyanine dyes described in JP-A-59-40638, JP-A-59- 40636 and JP-A-59-38739 are included in these sensitizing dyes.

Dye image forming couplers can be incorporated as coloring materials in the photographic material of the present invention. Alternatively, development may be carried out with developing solutions containing dye image forming couplers.

Examples of cyan, magenta and yellow couplers which can be used in the present invention are described in patents cited in *Research Disclosure* (RD), No. 17643 (December, 1978), item VII-D and ibid., No. 18717 (November, 1979).

There can be used couplers giving color forming dyes which are properly diffusing, non-color forming couplers, DIR couplers releasing a development restrainer by a coupling reaction, and couplers releasing a development accelerator.

Typical examples of yellow couplers which can be used in the present invention are the oil protect type acylacetamide couplers.

Two equivalent type yellow couplers are preferably used in the present invention. Typical examples thereof are the oxygen atom elimination type yellow couplers and the nitrogen atom elimination type yellow couplers. α-Pivaloylacetanilide couplers give color dyes which are excellent in fastness, particularly fastness to light, and α-benzoylacetanilide couplers give high color density.

Examples of magenta couplers which can be used in the present invention include oil protect type indazolone couplers, cyanoacetyl couplers, and preferably 5-pyrazolone couplers and pyrazoloazole couplers such as pyrazolotriazole. 5-Pyrazolone couplers having an arylamino group or an acylamino group at the 3-position are preferred from the viewpoint of the hue and color density of the color forming dyes. Nitrogen atom elimination groups described in U.S. Pat. No. 4,310,619 and arylthio groups described in U.S. Pat. No. 4,351,897 are preferred as the elimination groups of two equivalent type 5-pyrazolone couplers. 5-Pyrazolone couplers having a ballast group described in European Patent 73,636 give high color density.

Examples of the pyrazoloazole couplers include pyrazolobenzimidazoles described in U.S. Pat. No. 3,379,899, preferably pyrazolo[5,1-c][1,2,4]triazoles described in U.S. Pat. No. 3,725,067, pyrazolotetrazoles described in *Research Disclosure,* N. 24220 (June, 1984) and pyrazolopyrazoles described in *Research Disclosure,* No. 24230 (June, 1984). Imidazo[1,2-b]pyrazoles described in European Patent 119,741 are preferred from the view point of fastness to light and less secondary absorption of yellow of formed color dyes, and pyrazolo[1,5-b][1,2,4]triazole described in European Patent 119,860 is particularly preferred.

Cyan couplers which can be used in the present invention include oil protect type naphthol couplers and phenol couplers. Typical examples of the naphthol couplers include naphthol couplers described in U.S. Pat. No. 2,474,293 and preferably oxygen atom elimination type two equivalent type naphthol couplers described in U.S. Pat. Nos. 4,052,212, 4,146,396, 4,228,233 and 4,296,200. Examples of the phenol couplers include those described in U.S. Pat. Nos. 2,369,929, 2,801,171, 2,772,162 and 2,895,826. Cyan couplers having fastness to moisture and heat are preferably used in the present invention. Typical examples thereof include phenol cyan couplers having an ethyl group of a higher alkyl group at the meta-position of the phenol nucleus, 2,5-diacylamino-substituted phenol couplers and phenol couplers having a phenylureido group at the 2-position and acylamino group at the 5-position described in U.S. Pat. No. 3,772,002.

It is preferred that colored couplers in combination with the above couplers are used in color photographic materials for photographing to correct unnecessary absorption in the region of short wave for dyes formed from magenta and cyan couplers.

Couplers giving color dyes which are properly diffusing can be used to improve graininess. Such dye-diffusing couplers include magenta couplers described in U.S. Pat. No. 4,366,237 and British Patent 2,125,570 and yellow, magenta or cyan couplers described in European Patent 96,570 and West German Patent Application (OPI) No. 3,234,533.

The dye forming couplers and the above-described specific couplers may be in the form of a dimer or higher polymer. Typical examples of the dye forming polymer couplers are described in U.S. Pat. Nos. 3,451,820 and 4,080,211. Examples of magenta polymer couplers are described in British Patent 2,102,173 and U.S. Pat. No. 4,367,282.

Various kinds of couplers which are used in the present invention may be used in such a manner that two or more kinds of couplers in combination may be used for the same layer of the photographic layers, or the same compound may be introduced into two or more different layers to meet requirements of characteristics required for the photographic materials.

The color couplers are generally used in an amount of 0.001 to 1 mol per mol of sensitive silver halide. Yellow couplers are used in an amount of 0.01 to 0.5 mol, magenta couplers are used in an amount of 0.003 to 0.3 mol, and cyan couplers are used in an amount of 0.002 to 0.3 mol.

In the present invention, developing agents such as hydroxybenzenes (e.g., hydroquinone), aminophenols and 3-pyrazolidones may be incorporated in emulsions or photographic materials.

Photographic emulsions which are used in the present invention can be used in combination with dye image donating compounds (coloring materials) for color diffusion transfer process, said compounds releasing diffusing dye corresponding to the development of silver halide, to obtain a desired transferred image on an image receiving layer after appropriate development processing. Many coloring materials for color diffusion transfer process are known. Among them, there are preferred coloring materials (hereinafter referred to as DRR compound) which are initially nondiffusing, but are cleaved by the oxidation-reduction reaction with the oxidation products of developing agents (or electron transfer agents) to release diffusing dyes. Among them, DRR compounds having N-substituted sulfamoyl group are preferred. Particularly preferred DRR compounds suitable for use in combination with the nucleating agents of the present invention are the DRR compounds having o-hydroxyarylsulfamoyl group described in U.S. Pat. Nos. 4,055,428, 4,053,312 and 4,336,322 and the DRR compounds having redox parent nucleus described in JP-A-53-149328. When used in combination with such DRR compounds, temperature dependence during processing in particular is remarkably low.

It is preferred that after the photographic material of the present invention is imagewise exposed, da irect positive color image is formed by (1) carrying out color development with surface developing solutions having a pH of not higher than 11.5 and containing aromatic primary amine color developing agents and (2) conducting bleaching-fixing treatment after or while fogging treatment is carried out by light or nucleating agents. It is more preferred that the pH of the developing solutions is in the range of 11.0 to 10.0.

The fogging treatment of the present invention may be carried out by a so-called light fogging method wherein a second exposure is applied to the whole surface of light-sensitive layer or by a so-called chemical fogging method wherein development is carried out in the presence of a nucleating agent. If desired, development may be conducted in the presence of a nucleating agent and fogging light, or a photographic material containing a nucleating agent may be subjected to fogging exposure.

The light fogging method is described in the aforesaid JP-A-63-108336 (page 47 line 4 to page 49 line 5). Nucleating agents which can be used in the present invention are described in JP-A-63-108336 (page 49 line 6 to page 67 line 2). The compounds represented by the formulas [N-1] and [N-2] are particularly preferred. Preferred examples of these compounds are the following compounds.

(N-I-1): 6-ethoxy-2-methyl-1-propargylquinolineium bromide (N-I-2): 2,4-dimethyl-1-propargylquinolinium bromide (N-I-3): 2-methyl-1-{3-[2-(4-methylphenyl)hydrazono]-butyl}quinolinium iodide (N-I-4): 3,4-dimethyl-dihydropyrido[2,1-b]benzothiazolium bromide (N-I-5): 6-ethoxythiocarbonylamino-2-methyl-1-propargyl-quinolinium trifluoromethanesulfonate (N-I-6): 2-methyl-6-(3-phenylthioureido)-1-propargylquinolium bromide (N-I-7): 6-(5-benzotriazolocarboxyamido)-2-methyl-1-propargylquinolinium trifluoromethanesulfonate (N-I-8): 6-[3-(2-mercaptoethyl)ureido]-2-methyl-1-propargylquinolinium trifluoromethanesulfonate (N-I-9): 6-{3-[3-(5-mercapto-thiadiazolo-2-ylthio)-propyl]-ureido-2-methyl-1-propargylquinolinium}trifluoromethanesulfonate (N-I-10): 6-(5-mercaptotetrazolo-1-yl)-2-methyl-1-propargylquinolinium iodide (N-II-1): 1-formyl-2-{4-[3-(2-methoxyphenyl)ureido]-phenyl}hydrazine (N-II-2): 1-formyl-2-{4-[3-{3-[3-(2,4-di-tert-pentylphenoxy)propyl]ureido}phenylsulfonylamino]-phenyl}hydrazine (N-II-3): 1-formyl-2-{4-[3-(5-mercaptotetrazolo-1--yl)benzamido]phenyl}hydrazine (N-II-4): 1-formyl-2-[4-{3-[3-(5-mercaptotetrazolo-1-yl)-phenyl]ureido}phenyl]hydrazine (N-II-5): 1-fromyl-2-[4-{3-[N-(5-mercapto-4-methyl-1,2,4-triazolo-3-yl)carbamoyl]propaneamido}phenyl]-hydrazine (N-II-6): 1formyl-2-{4-[3-{N-[4-(3-mercapto-1,2,4-triazolo-4-yl)phenyl]carbamoyl}propaneamido]-phenyl}hydrazine (N-II-7): 1-formyl-2-[4-{3-[N-(5-mercapto-1,3,4-thiadiazolo-2-yl)carbamoyl]propaneamide}phenyl]-hydrazine (N-II-8): 2-[4-(benzotriazolo-5-carboxamido)-phenyl]-1-formylhydrazine (N-II-9): 2-[4-{3-[N-benzotriazolo-5-carboxamido)carbamoyl]propaneamido}phenyl]-1-formylhydrazine (N-II-10): 1-formyl-2-{4-[1-(N-phenylcarbamoyl)thiosemi-carbazido]phenyl}hydrazine (N-II-11): 1-formyl-2-{4-[3-(phenylthioureido)benzamido]-phenyl}hydrazine (N-II-12): 1-formyl-2-[4-{3-hexylureido)phenyl]hydrazine Nucleation accelerators which can be used in the present invention are described in JP-A-63-108336 (page 68, line 11 to page 71, line 3). Preferred examples thereof are the compounds represented by (A-1) to (A-13) described in JP-A-63-108336 (pages 69 to 70).

Color developing solutions which can be used in the development of the photographic material of the present invention are described in JP-A-63-108336 (page 71, line 4 to page 72, line 9). Particularly preferred examples of aromatic primary amine color developing agents include p-phenylenediamine compounds. Typical examples thereof include 3-methyl-4-amino-N-ethyl-N-(β-methanesulfonamidoethyl)aniline, 3-methyl-4-amino-N-ethyl-N-(β-hydroxyethyl)aniline, 3-methyl-4-amino-N-ethyl-N-methoxyethylaniline and salts thereof such as sulfate and hydrochloride.

In addition to the above color developing agents, black-and-white developing agents such as phenidone derivatives can be used to form direct positive color image by a color diffusion transfer process using the photographic material of the present invention.

After color development, the photographic emulsion layers are generally bleached. Bleaching and fixing may be carried out simultaneously with one bath for bleaching-fixing treatment, or they may be separately carried out. After bleaching, a bleaching-fixing treatment may be conducted to expedite processing. After fixing, a bleaching-fixing treatment may be carried out. Generally, iron complex salts of aminopolycarboxylic acids are used as bleaching agents for the bleaching solution or bleaching-fixing solution of the present invention. The bleaching solution or bleaching-fixing solution of the present invention may contain additives. For example, compounds described in JP-A-62-215272 (pages 22 to 30) can be used as the additives. After desilverization (bleaching-fixing or fixing), rinsing and/or stabilization are/is carried out. Preferably, softened water is used for rinsing water or stabilizing solution. Examples of methods for softening water include methods using ion exchange resins or reverse osmosis device described in JP-A-62-288838. Concretely, these methods are preferably carried out according to the methods described in JP-A-62-288838.

Compounds described in JP-A-62-215272 (pages 30 to 36) can be used as additives for the rinsing stage and the stabilization stage.

It is preferred that the amount of replenisher in each stage is as small as possible. The amount of the replenisher per unit area of photographic material is preferably 0.1 to 50 times, more preferably 3 to 30 times, the amount brought over from the previous bath.

The present invention is now illustrated in greater detail by reference to the following examples which, however, are not to be construed as limiting the invention in any way.

EXAMPLE 1

An aqueous solution of silver nitrate and an aqueous solution of potassium iodide and potassium bromide were added simultaneously over a period of 60 minutes to an aqueous gelatin solution which was being maintained at 50° C. in the presence of $4\times10^{-7}$ mol/mol.Ag of potassium hexachloroiridium(III) and ammonia while maintaining the pAg value at 7.8. A cubic monodisperse emulsion of average grain size 0.28 μm and of average silver iodide content 0.3 mol. % was obtained. After de-salting this emulsion using the flocculation method, 40 grams of inactive gelatin was added per mol of silver and then 5,5'-dichloro-9-ethyl-3,3'-bis(3-sulfopropyl)oxacarbocyanine as a sensitizing dye and a solution containing $10^{-3}$ mol of KI per mol of silver were added while maintaining the emulsion at 50° C. The temperature was lowered after ageing for 15 minutes. The emulsion was dissolved again and 0.02 mol/mol.Ag of methylhydroquinone and hydrazine compounds of the present invention and comparative hydrazines, as shown in Table 1, were added at 40° C., and 5-methylbenzotriazole, 4-hydroxy-1,3,3a,7-tetra-azaindene, 0.4 g/m² of a dispersion of the development accelerators (a) and (b) indicated below and poly(ethyl acrylate), and a mixture of the compounds (c), (d) and (e) indicated below as gelatin hardening agents were added. The mixtures were coated on poly(ethylene terephthalate) films (150 μm) which had a waterproof subbing layer (0.5 μm) comprised of vinylidene chloride copolymer in such a way as to provide coated silver weights of 3.4 g/m²

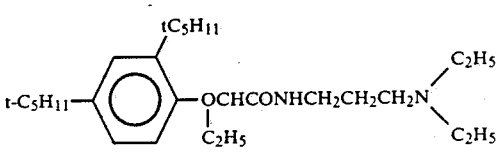

(a)

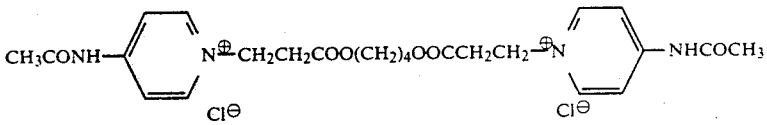

(b)

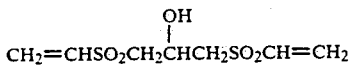

(c)

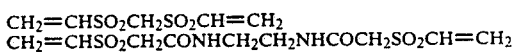

(d)

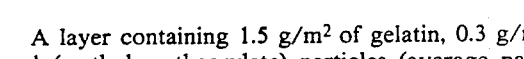

(e)

A layer containing 1.5 g/m² of gelatin, 0.3 g/m² of poly(methyl methacrylate) particles (average particle size 2.5 μm) and the surfactants indicated below was coated over the top as a protective layer.

| Surfactants: | |
|---|---|
| 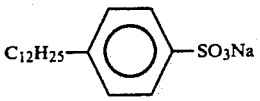 | 37 mg/m² |
| $CH_2COOC_6H_{13}$<br>\|<br>$CHCOOC_6H_{13}$<br>\|<br>$SO_3Na$ | 37 mg/m² |
| $C_8F_{17}SO_2NCH_2COOK$<br>\|<br>$C_3H_7$ | 2.5 mg/m² |

(1) Evaluation of Contrast Hardening Performance

These samples were exposed through an optical wedge using tungsten light of color temperature 3200° K., after which they were developed for 30 seconds at 34° C. in the Developer I indicated below, fixed with a fixer FR-Fl (made by Fuji Photo Film Co., Ltd.) at 30° C. for 30 seconds, washed with water for seconds and dried at 45° C. for 20 seconds. The photographic properties of sensitivity and gradation obtained were as shown in Table 1. High sensitivity and high contrast were obtained when the nucleating agents of the present invention were used.

| Developer I | |
|---|---|
| Hydroquinone | 50.0 grams |
| N-Methyl-p-Aminophenol | 0.3 gram |
| Sodium hydroxide | 18.0 grams |
| 5-Sulfosalicylic acid | 55.0 grams |
| Potassium sulfite | 110.0 grams |
| Ethylenediamine tetra-acetic acid di-sodium salt | 1.0 gram |
| Potassium bromide | 10.0 grams |
| 5-Methylbenzotriazole | 0.4 gram |
| 2-Mercaptobenzimidazole-5-sulfonic acid | 0.3 gram |
| Sodium 3-(5-mercaptotetrazole)benzene-sulfonate | 0.2 gram |
| N-n-Butyldiethanolamine | 15.0 grams |
| Sodium toluenesulfonate | 8.0 grams |
| Water to make | 1 liter |
| pH adjusted to 11.6 (by adding potassium hydroxide) | pH 11.6 |

(2) Evaluation of Photographic Properties in A Fatigued Developer

An FG 660 F type automatic processor for photomechanical process (made by the Fuji Photo Film Co.) was filled with the above mentioned Developer I and samples were developed for 30 seconds at 34° C. fixed, washed with water and dried under the three sets of conditions indicated below.

(A) Development processing was carried out immediately after the temperature of the developer which had been introduced into the automatic processor reached 34° C. (Development with Fresh Developer)

(B) Development processing was carried in a developer which had been left to stand for 4 days after being introduced into the automatic processor. (Development with Aerially Fatigued Developer)

(C) Development processing was carried out in a developer which, after filling the automatic processor, had been used repeatedly for five days, processing each day 200 sheets of Fuji Photo Film Co., Ltd.'s GRANDEX GA-100 film of size 50.8 cm×61.0 cm which had been exposed in such a way that 50% of the area was developed. Replenishment was carried out at the rate of 100 cc of Developer I per sheet of film. (Development with Mass Processing Fatigued Developer).

The photographic properties obtained are shown in Table 1. In connection with the running stability, the photographic properties obtained under conditions (B) and (C) should be no different to those obtained under conditions (A). It is clear from the results shown in Table 1 that, when the nucleating agents of the present invention were used there was little change in photographic sensitivity even when the developer was fatigued.

-continued terms of log E, which is to say ten times, lower than that of the blank.

**Gradation (G): The gradient of the straight line joining the points of density 0.3 and 3.0 on the characteristic curve. A larger value indicates higher contrast.

***$\Delta S_{B-A}$: The difference between the sensitivity ($S_B$) when developed in aerially fatigued developer and the sensitivity ($S_A$) when developed in fresh developer.

****$\Delta S_{C-A}$ The difference between the sensitivity ($S_C$) when developed in mass processing fatigued developer and the sensitivity ($S_A$) when developed in fresh developer.

TABLE 1

| | Nucleating Agent | | Photographic Characteristics with Fresh Bath | | Change in Photographic Performance in Fatigued Baths | |
|---|---|---|---|---|---|---|
| Sample No. | Type | Amount Added (mol/mol•Ag) | Sensitivity (S)* | Gradation (G)** | Aerially Fatigued Bath ($\Delta S_{B-A}$)*** | Bath Fatigued by Mass Processing ($\Delta S_{C-A}$)**** |
| 1 Comp. Ex. 1 | Blank | — | 0 | 2.6 | — | — |
| 2 Comp. Ex. 2 | Comparative Compound A | $2.5 \times 10^{-4}$ | +0.45 | 12.3 | +0.23 | −0.20 |
| 3 Comp. Ex. 3 | Comparative Compound B | $2.5 \times 10^{-4}$ | +0.24 | 10.1 | +0.18 | −0.14 |
| 4 Invention 1 | Compound 1 | $2.5 \times 10^{-4}$ | +0.35 | 10.3 | +0.17 | −0.12 |
| 5 Invention 2 | Compound 4 | $2.5 \times 10^{-4}$ | +0.38 | 10.7 | +0.16 | −0.12 |
| 6 Invention 3 | Compound 8 | $2.5 \times 10^{-4}$ | +0.40 | 11.5 | +0.15 | −0.10 |
| 7 Invention 4 | Compound 10 | $2.5 \times 10^{-4}$ | +0.46 | 12.3 | +0.16 | −0.11 |
| 8 Invention 5 | Compound 14 | $2.5 \times 10^{-4}$ | +0.49 | 13.1 | +0.10 | −0.10 |
| 9 Invention 6 | Compound 17 | $2.5 \times 10^{-4}$ | +0.46 | 12.8 | +0.09 | −0.10 |
| 10 Invention 7 | Compound 18 | $2.5 \times 10^{-4}$ | +0.51 | 13.5 | +0.12 | −0.09 |
| 11 Comp. Ex. 4 | Comparative Compound C | $5.0 \times 10^{-5}$ | +0.16 | 8.5 | +0.35 | −0.18 |
| 12 Invention 8 | Compound 21 | $5.0 \times 10^{-5}$ | +0.25 | 10.5 | +0.17 | −0.13 |
| 13 Invention 9 | Compound 22 | $5.0 \times 10^{-5}$ | +0.33 | 11.8 | +0.15 | −0.13 |
| 14 Invention 10 | Compound 23 | $5.0 \times 10^{-5}$ | +0.40 | 13.3 | +0.13 | −0.12 |
| 15 Invention 11 | Compound 27 | $5.0 \times 10^{-5}$ | +0.35 | 12.0 | +0.15 | −0.13 |
| 16 Invention 12 | Compound 30 | $5.0 \times 10^{-5}$ | +0.18 | 10.3 | +0.17 | −0.13 |

Comparative Compound Cpd. A

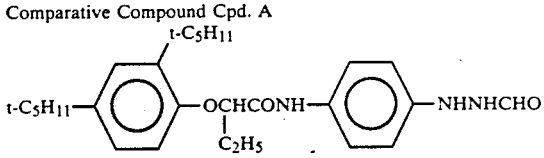

Comparative Compound Cpd. B

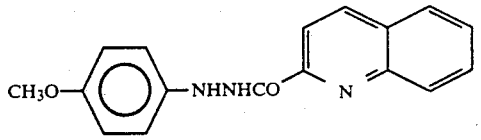

Comparative Compound Cpd. C

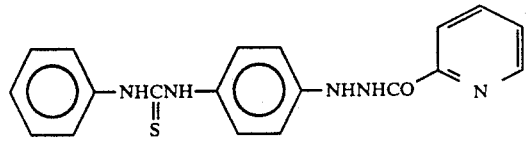

*Sensitivity: Sensitivity is shown as a difference from the sensitivity (logE) of the blank which was used as a standard. Hence, a value of −1.0 signifies that the sensitivity was 1.0 in

EXAMPLE 2

An aqueous solution of silver nitrate and an aqueous solution of sodium chloride were mixed simultaneously with an aqueous gelatin solution which was being maintained at 50° C. in the presence of $5.0 \times 10^{-6}$ mol per mol.Ag of $(NH_4)_3RhCl_6$, after which the soluble salts were removed using a method well known in the industry. Gelatin was then added and, without chemical ripening, 2-methyl-4-hydroxy-1,3,3a-7-tetra-azaindene was added as a stabilizer. This emulsion was a mono-disperse emulsion of cubic crystals of average grain size 0.15 μm.

Hydrazine compounds (nucleating agents) were added to this emulsion, as shown in Table 2, 30 wt. % as solid fraction with respect to gelatin of poly(ethyl acrylate) latex was added, the mixture of the three types of compounds used in Example 1 was added as a film hardening agent, and the mixtures were coated onto polyester supports so as to provide coated silver weights of 3.8 g/m². The gelatin coated weight was 1.8 g/m². A protective layer which contained 1.5 g/m² of gelatin, 0.3 g/m² of poly(methyl methacrylate) particles (average particle size 2.5 μm) as a matting agent, the surfactants indicated below as coating promotors, and the stabilizer and ultraviolet absorbing dye indicated below was coated over the top and dried.

Surfactants:

-continued

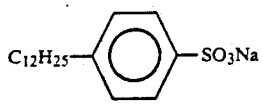

37 mg/m²

$CH_2COOC_6H_{13}$
|
$CHCOOC_6H_{13}$
|
$SO_3Na$ 37 mg/m²

$C_8F_{17}SO_2NCH_2COOK$
|
$C_3H_7$ 2.5 mg/m²

Stabilizer:
Thioctic acid 2.1 mg/m²

Ultraviolet Absorbing Dye:

100 mg/m²

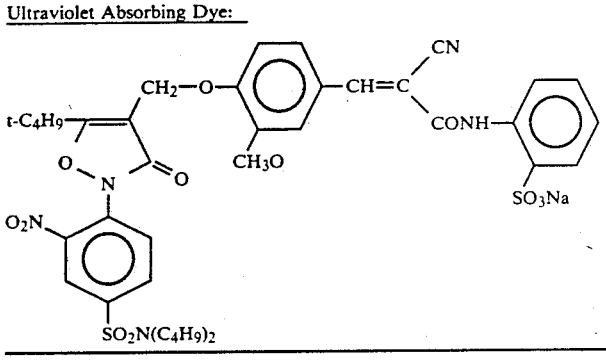

These samples were exposed through an optical wedge using a Dainippon Screen (Co.) P-607 light-room printer, developed for 20 seconds at 38° C., fixed with a fixer GR-Fl (made by Fuji Photo Film Co., Ltd.) at 30° C. for 30 seconds, washed with water for 30 seconds and dried at 45° C. for 20 seconds.

The results obtained on monitoring the photographic properties were as shown in Table 2.

It is clear from the results shown in Table 2 that on testing the photographic performance in fatigued developers in the same way as described in Example 1, the samples of the present invention showed little variation, as shown in Table 2, and gave the desired results.

TABLE 2

| Sample No. | Nucleating Agent: Type | Nucleating Agent: Amount Added (mol/mol · Ag) | Photographic Characteristics with Fresh Bath: Sensitivity (S)* | Photographic Characteristics with Fresh Bath: Gradation (G)** | Change in Photographic Performance in Fatigued Baths: Aerially Fatigued Bath ($\Delta S_{B-A}$)*** | Change in Photographic Performance in Fatigued Baths: Bath Fatigued by Mass Processing ($\Delta S_{C-A}$)**** |
|---|---|---|---|---|---|---|
| 1 Comp. Ex. 1 | Blank | — | 0 | 4.8 | — | — |
| 2 Comp. Ex. 2 | Comparative Compound A | $1.5 \times 10^{-3}$ | +0.16 | 9.2 | +0.11 | −0.09 |
| 3 Comp. Ex. 3 | Comparative Compound B | " | +0.14 | 7.9 | +0.10 | −0.09 |
| 4 Invention 1 | Compound 1 | " | +0.19 | 10.0 | +0.10 | −0.07 |
| 5 Invention 2 | Compound 4 | " | +0.18 | 10.0 | +0.10 | −0.08 |
| 6 Invention 3 | Compound 8 | " | +0.22 | 10.5 | +0.09 | −0.07 |
| 7 Invention 4 | Compound 10 | " | +0.23 | 10.3 | +0.09 | −0.07 |
| 8 Invention 5 | Compound 14 | " | +0.28 | 11.6 | +0.06 | −0.06 |
| 9 Invention 6 | Compound 17 | " | +0.27 | 11.3 | +0.07 | −0.06 |
| 10 Invention 7 | Compound 18 | " | +0.29 | 11.7 | +0.06 | −0.06 |
| 11 Comp. Ex. 4 | Comparative Compound C | $3.0 \times 10^{-4}$ | +0.06 | 7.5 | +0.18 | −0.12 |
| 12 Invention 8 | Compound 21 | $3.0 \times 10^{-4}$ | +0.18 | 10.1 | +0.12 | −0.08 |
| 13 Invention 9 | Compound 22 | " | +0.19 | 10.3 | +0.12 | −0.08 |
| 14 Invention 10 | Compound 23 | " | +0.22 | 10.9 | +0.11 | −0.07 |
| 15 Invention 11 | Compound 27 | " | +0.20 | 10.5 | +0.11 | −0.07 |
| 16 Invention 12 | Compound 30 | " | +0.19 | 10.4 | +0.12 | −0.07 |

The symbols *, , *, and **** have the same meaning as in Table 1.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having at least one hydrophilic colloid layer, wherein at least one hydrophilic colloid layer is a silver halide photographic emulsion layer, and at least one hydrophilic colloid layer contains a compound represented by the general formula (I):

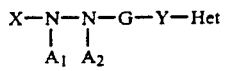

(I)

wherein $A_1$ and $A_2$ both represent hydrogen atoms, or one of them represents a hydrogen atom and the other represents a sulfonyl group or

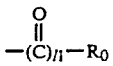

(wherein $R_0$ represents an alkyl group, an alkenyl group, an aryl group, an alkoxy group or an aryloxy group, and $l_1$ represents 1 or 2); G represents

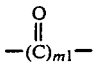

(wherein $m_1$ represents 1 or 2), $—SO_2—$, —SO—,

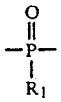

(wherein $R_1$ represents an alkoxy group or an aryloxy group), a thiocarbonyl group or an iminomethylene group; X represents a substituted or unsubstituted aliphatic group, a substituted or unsubstituted aromatic group or a substituted or unsubstituted heterocyclic group; Y represents a substituted or unsubstituted aliphatic group or a substituted or unsubstituted aromatic group; and Het represents a neutral nitrogen containing heterocyclic aromatic group.

2. A silver halide photographic material as in claim 1, wherein both $A_1$ and $A_2$ are hydrogen atoms.

3. A silver halide photographic material as in claim 1, wherein G in general formula (I) represents

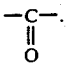

4. A silver halide photographic material as in claim 1, wherein Y in general formula (I) represents a substituted or unsubstituted methylene, ethylene or trimethylene group.

5. A silver halide photographic material as in claim 1, wherein Het in general formula (I) is a group derived from an imidazole ring, a pyridine ring or a quinoline ring.

6. A silver halide photographic material as in claim 1, wherein Het in general formula (I) is a group derived from an imidazole ring.

7. A silver halide photographic material as in claim 1, wherein at least one of Het, X and Y in general formula (I) contains a group which promotes adsorption on silver halide.

8. A silver halide photographic material as in claim 1, wherein the compound of general formula (I) is present in an amount of $1\times10^{-6}$ to $5\times10^{-2}$ mol per mol of silver halide.

9. A silver halide photographic material as in claim 1, wherein the compound of general formula (I) is present in an amount of $1\times10^{-5}$ to $1\times10^{-2}$ mol per mol of silver halide.

10. A silver halide photographic material as in claim 1, wherein Y in general formula (I) represents a substituted or unsubstituted alkylene group.

* * * * *